United States Patent [19]

Brandewie et al.

[11] 4,136,440

[45] Jan. 30, 1979

[54] ELECTRICAL HARNESS FABRICATION METHOD AND APPARATUS

[75] Inventors: Joseph E. Brandewie, Clearwater, Fla.; Kenneth F. Folk; Milton D. Ross, both of Harrisburg, Pa.

[73] Assignee: AMP Incorporated, Harrisburg, Pa.

[21] Appl. No.: 815,046

[22] Filed: Jul. 12, 1977

[51] Int. Cl.[2] ..... H01R 43/00

[52] U.S. Cl. ..... 29/628; 29/564.4; 29/749

[58] Field of Search ..... 29/564.4, 564.6, 564.8, 29/566.2, 566.3, 628, 630 A, 747, 749, 753, 759; 81/9.5 R, 9.5 A, 9.51

[56] References Cited

U.S. PATENT DOCUMENTS

| | | | |
|---|---|---|---|
| 3,309,948 | 3/1967 | Falken | 81/9.51 |
| 3,353,571 | 11/1967 | Durr et al. | 140/1 |
| 3,782,227 | 1/1974 | Veenendaal | 81/9.51 |
| 3,817,127 | 6/1974 | Soeller | 81/9.51 |
| 3,887,999 | 6/1975 | Ross et al. | 29/630 A |
| 3,909,900 | 10/1975 | Gudmestad | 29/628 |
| 3,939,552 | 2/1976 | Hart et al. | 29/628 |
| 4,043,017 | 8/1977 | Folk et al. | 29/749 |
| 4,043,034 | 8/1977 | Sucheski et al. | 29/628 |

*Primary Examiner*—Michael J. Keenan

*Attorney, Agent, or Firm*—Anthony S. Volpe

[57] ABSTRACT

Apparatus and method for fabricating a multi-wire harness assembly are disclosed. The harness consists of a multi-contact electrical connector with a plurality of wires of diverse lengths attached thereto. The free ends of the wires have been differentially stripped for the application of electrical terminals. The fabrication apparatus consists of spaced wire insertion and stripping stations. Wire lengthening blades, located between the wire insertion and stripping stations, pull wires through wire stripping blades to differentially remove the insulation from one end.

22 Claims, 17 Drawing Figures

Fig 6A
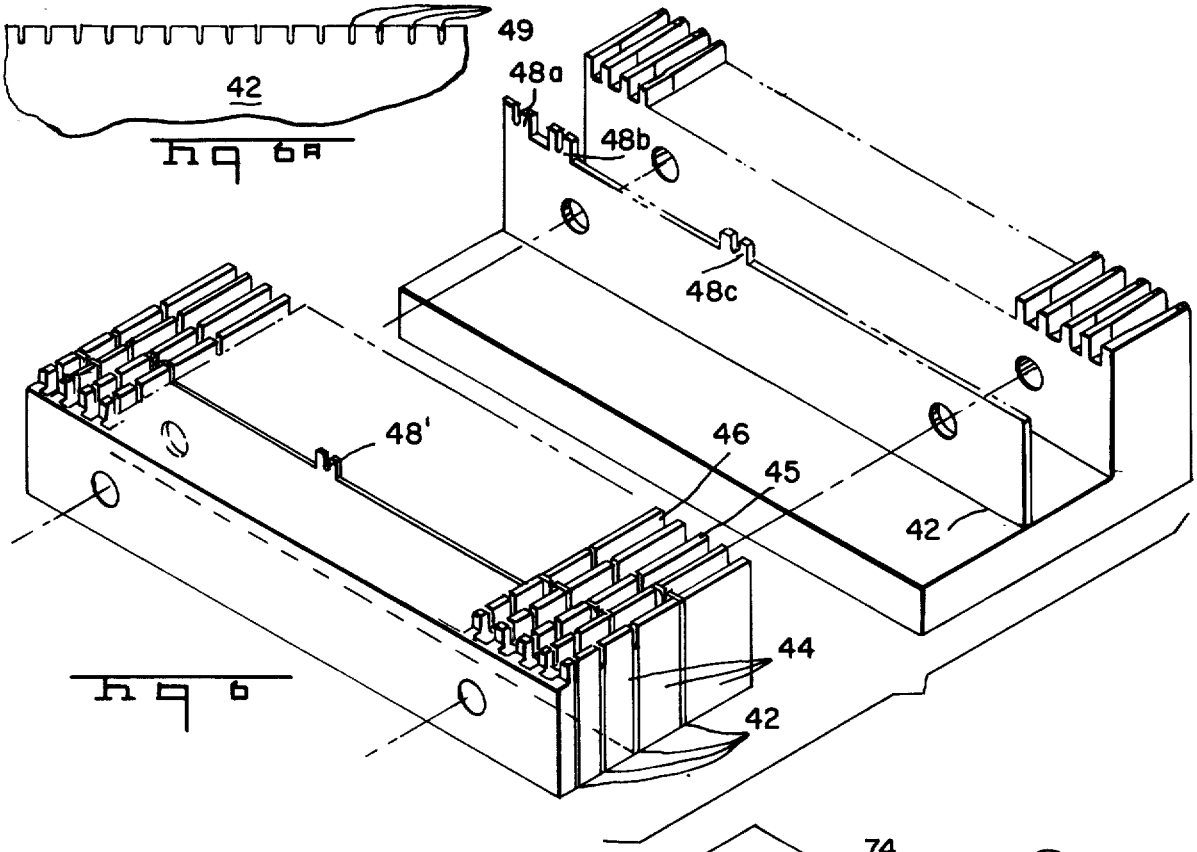
Fig 6
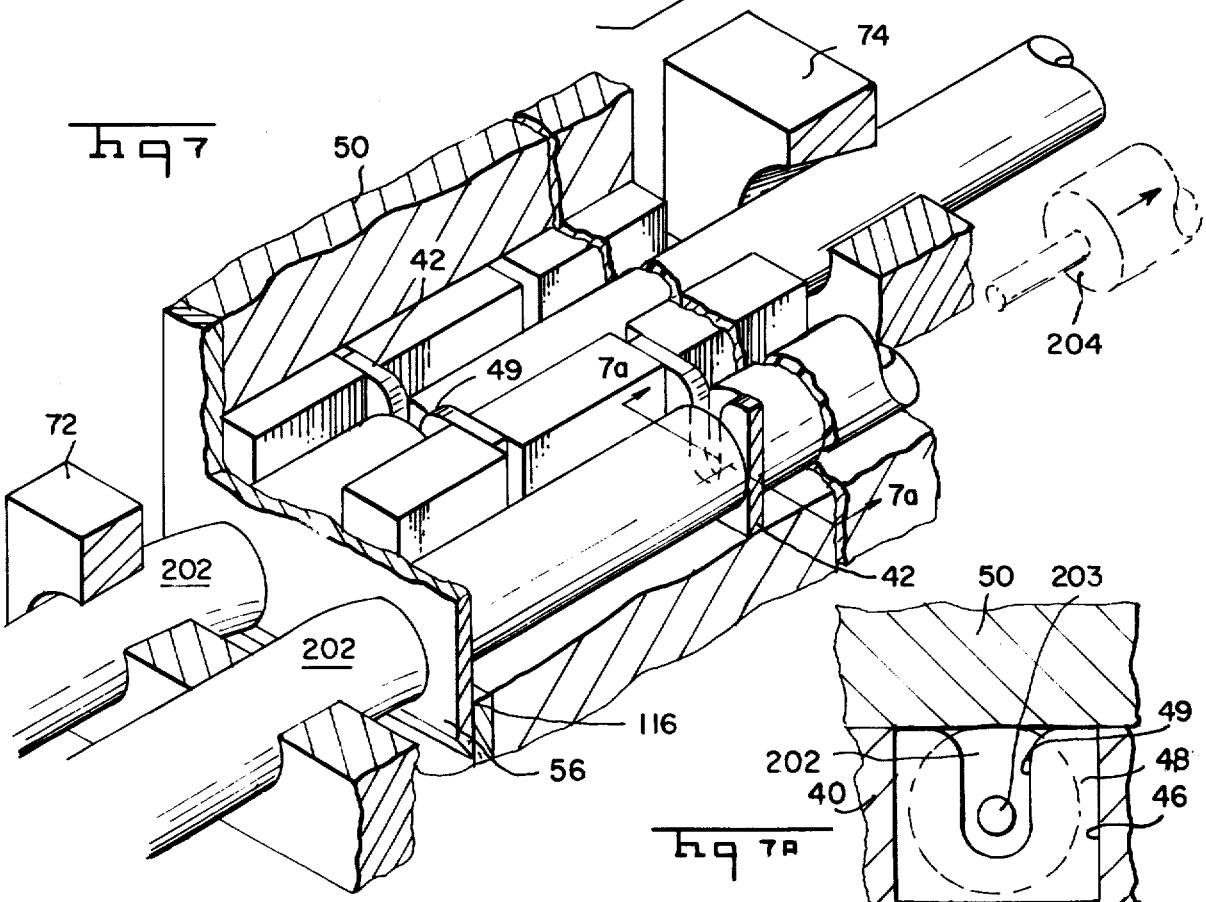
Fig 7
Fig 7A

ELECTRICAL HARNESS FABRICATION METHOD AND APPARATUS

BACKGROUND OF THE INVENTION

1. Field of the Invention

This invention relates to assembling electrical apparatus comprising a plurality of electrical wires. More specifically, this invention relates to the fabrication of an electrical harness comprising a single multi-contact electrical connector and a plurality of wires of different length. This invention also relates to simultaneous differential stripping of the insulation from the free ends of a plurality of wires.

2. Description of the Prior Art

Harness assemblies have long been fabricated by lacing wires along a prescribed pattern on a harness assembly board and subsequently applying electrical terminals to the ends thereof. This technique is largely manual and numerous attempts have been made to mechanize this operation. Although only illustrative, one such attempt to automate harness assembly is shown in U.S. Pat. No. 3,699,630.

With the advent of pre-loaded multi-contact electrical connectors which utilize slotted-plate insulation piercing wire termination techniques, modifications in the traditional harness fabrication techniques have been suggested. An example of one such modification is disclosed and claimed in U.S. Pat. No. 3,859,724. That method employed a harness assembly board with wire terminations being made to multi-contact connectors at various stations on the harness board.

The initial use of multi-contact slotted-plate electrical connectors was to interconnect multi-conductor electrical cables. Such cables are used extensively in the telephone industry. To terminate each of the wires in a telephone cable the outer sheath must be removed and the wires must be individually attached to the individual terminals. The connector disclosed in U.S. Pat. No. 3,760,335 is generally used with telephone cables. This connector can be sequentially attached to wires by the automatic apparatus disclosed in U.S. Pat. No. 3,766,622 or the wires can be mass terminated by using the device disclosed in U.S. Pat. No. 3,758,935.

Harness assemblies need not use pre-assembled sheathed cable similar to those used in the telephone industry. In order to simplify the harness assembly operation, wires may be drawn from reels and attached to the multi-contact connectors. If necessary, the wires can be subsequently bundled to form a cable. One such example of a method for fabricating a harness having similar multi-contact electrical connectors at both ends of the intervening wires is shown in application Ser. No. 657,138 filed Feb. 11, 1976. Application Ser. No. 679,961 filed April 26, 1976, also discloses an apparatus and method for fabricating a similar harness. This harness can not be utilized when different wires must be deployed to different physical locations, however. The harness fabricated by the method and apparatus disclosed and claimed herein is intended for use with conventional discrete electrical terminals or connectors attached to one end of a harness with the wires attached to a single multi-contact electrical connector at the opposite end.

U.S. Pat. No. 3,939,552 discloses a differential wire feed mechanism for feeding two wires of variable length. The wires are also stripped by conventional means.

U.S. Pat. No. 3,964,147 discloses a connector assembly machine which accepts wires with terminals attached and inserts the wires into a connector housing.

In general, conventional discrete electrical connectors and terminals are terminated to the ends of wires by either soldering or crimping. In either case, the insulation must be stripped from the ends of the individual wires prior to soldering and crimping. Two examples of wire stripping apparatus are disclosed in U.S. Pat. Nos. 3,309,948 and 3,815,449. If different types of wire terminations are to be made to separate wires it may be necessary to provide for different strip lengths on different wires. This differential stripping capability must be combined with wire feed and insertion apparatus which allows repetitive fabrication of substantially identical harnesses at a more rapid rate than more conventional harness fabrication techniques.

SUMMARY OF THE INVENTION

This invention relates to an apparatus and a method for fabricating a multi-wire electrical harness. The electrical harness comprises a multi-contact electrical connector and a plurality of wires attached thereto. In general, the wires are of different lengths. The insulation on the free ends of the wires in the harness is generally removed to provide for application of a solder or crimped connector or terminal. The apparatus and method claimed herein incorporates the fabrication steps of: pulling wire from a supply source to a wire insertion station past a wire stripping station; inserting the ends of the wires into the multi-contact electrical connector at the insertion station; differentially lengthening the wires between a stripping station and the wire insertion station; severing the wires from their source; and differentially stripping the free ends of the wires. Wire stripping is accomplished by first pressing the wires into channels containing slotted stripping blades, subsequently shearing the wires adjacent one end of the channels, and the pulling of the wires through the channels to strip the insulation between the stripping blade and the sheared end. If blades are spaced at different distances from the ends of the channels at which shearing occurs, differential stripping results.

It is an object of this invention to provide a rapid fabrication technique for wire harness. More specifically, this invention provides a rapid method of making a harness using a single multi-contact connector with wires of different lengths. Differential wire stripping is also a primary object of this invention. Also, this invention is intended to provide a semi-automatic technique in which an operator can fabricate a harness basically by operating a reciprocal shuttle which draws the wire from its source and sequentially actuating levers to perform the various insertion, lengthening and stripping operations. This invention is also intended for use in fabricating electrical harnesses having as many as twenty separate wires.

Another object of this invention is to provide an inexpensive technique for simultaneously stripping the insulation from a portion of multiple wires. Accordingly, this invention is intended to function using inexpensive stripping blade assemblies. A further object of this invention is to allow the user to selectively fabricate a plurality of different multiple wire stripping assemblies from a standard set of components.

BRIEF DESCRIPTION OF THE DRAWINGS

FIGS. 6 & 7 are views showing wire stripping means.

FIG. 7A shows a cross-section of the wire stripping.

FIGS. 8–15 illustrate the stages of the harness fabrication method.

BRIEF DESCRIPTION OF THE INVENTION

Figure 2:
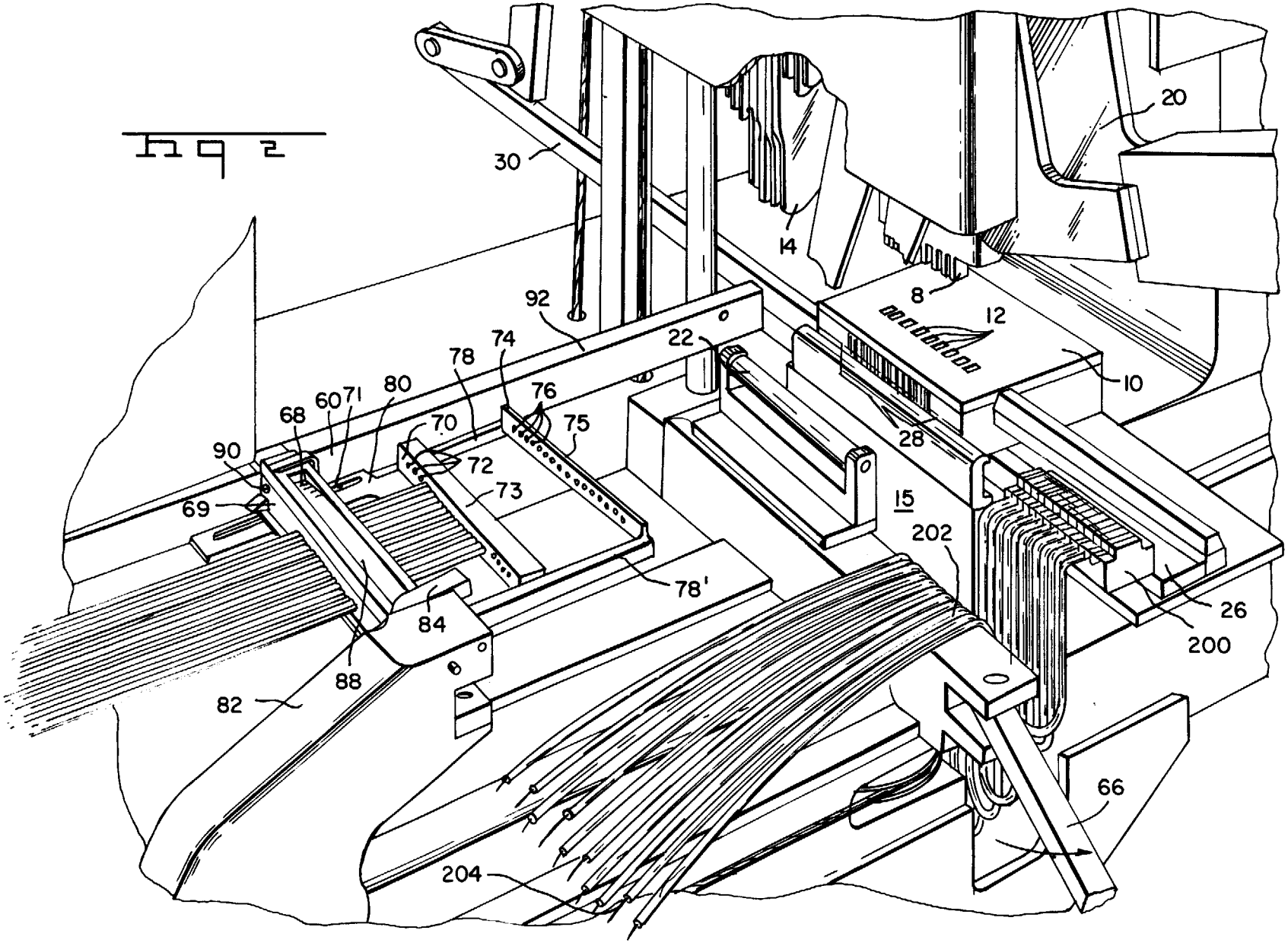
FIG. 2 is a perspective view showing the wire shuttle apparatus and the wire insertion station.

Multi-wire harness assemblies of the type shown in FIG. 2 can be fabricated using this harness applicator. Each harness consists of a single multi-contact electrical connector of the type generally represented by connector 200. Termination of wires in connector 200 is accomplished by moving the wires laterally of their axes into wire receiving terminals. These terminals can, in general, consist of plate-like members having a slotted portion for piercing the wire insulation and establishing electrical contact with the underlying wire. In a typical harness approximately twenty separate insulated wires 202 are attached adjacent one end to connector 200. In general, separate wires 202 will be of different lengths. In the harness, fabricated with this apparatus, the insulation on opposite ends 204 of wires 202 is stripped, leaving bare conductors. Individual terminals can then be crimped or soldered to stripped ends 204. The stripped ends can also be terminated by conventional wrap-type terminations or soldered in place. The amount of insulation stripped from ends 204 is, in general, different for different wires, to accomodate different types of terminals attached adjacent separate wires.

Figure 1:
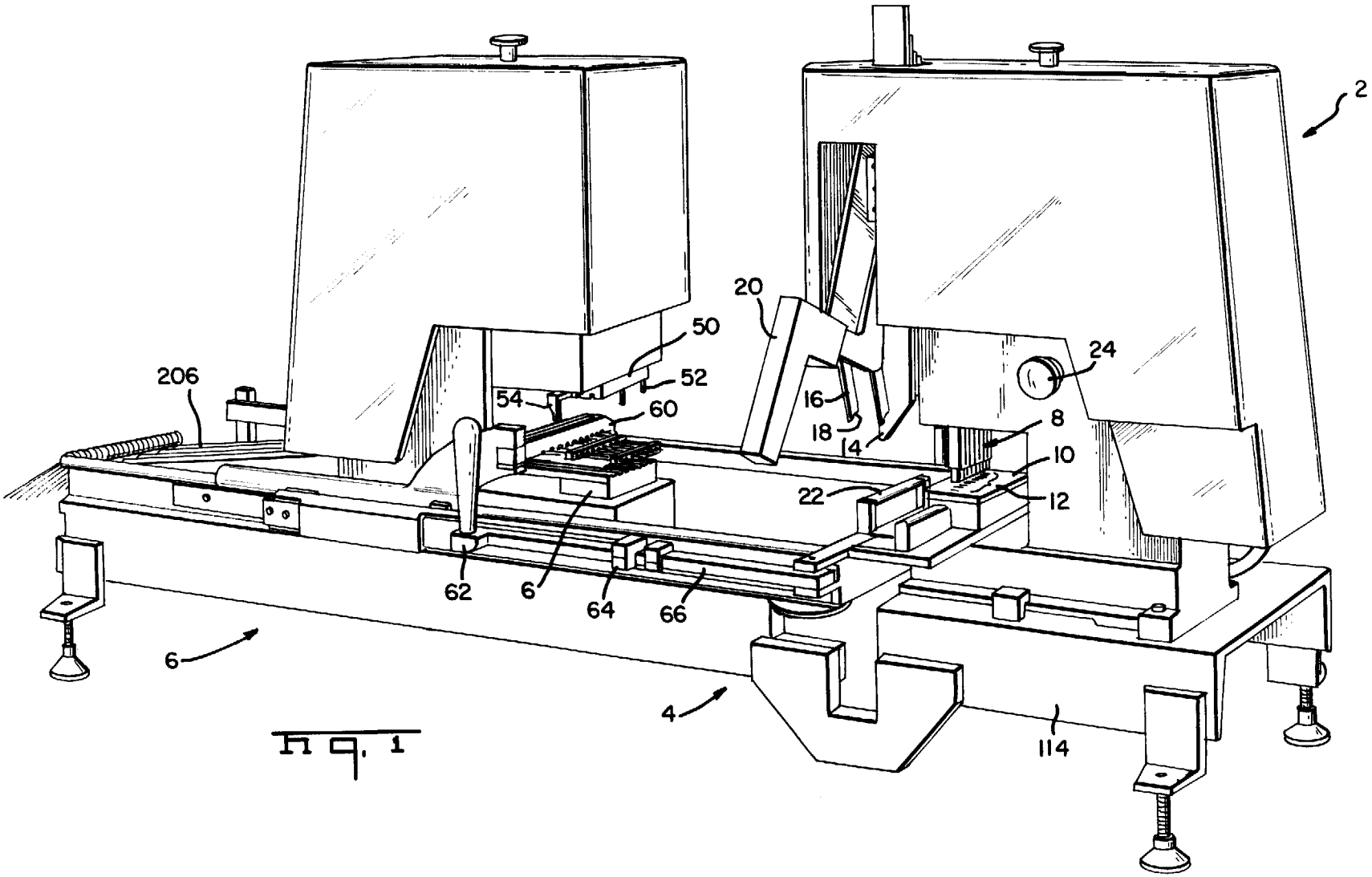
FIG. 1 is a perspective view of a multi-wire harness applicator.

Harness assembly apparatus 2 comprises a wire insertion station 4 and a wire stripping station 6 integrally mounted on a frame member 114. Reciprocal wire shuttle 60 is located on frame 114. Shuttle 60 as shown in FIG. 1 is located at wire stripping station 6. Reciprocal shuttle is movable through an extension phase from wire stripping station 6 to wire insertion station 4. Movement through a retraction phase comprises a return from station 4 to station 6.

Wire insertion station 4 generally comprises connector positioning means and reciprocal ram means. Neither the ram means nor the connector positioning means are explicitly shown. In general, the ram means can be actuated in any conventional manner and is adapted to drive wire stuffers 8 toward the connector positioning means. Template 110 is located along the path of stuffers 8. A connector 200, located in the wire positioning means, would be positioned immediately below template 10. Template 10 comprises a horizontal plate with a plurality of vertically extending slots 12. Each wire stuffer 8 is dimensioned to move through one slot 12. Template 10 further comprises a plurality of horizontal wire slots 28. Each wire slot 28 is generally aligned with a slot 12 and the path of one stuffer 8. A single terminal position on connector 200 would be generally aligned with a single stuffer 8, a single cooperating stuffer slot 12 and a single cooperating wire slot 28.

A plurality of lengthening blades 14 are located immediately adjacent wire inserters 8. Lengthening blades 14 travel along a vertical path generally parallel to that traversed by wire inserters 8. A recessed channel 15 is located adjacent to the connector positioning means and is in alignment with lengthening blades 14. Channel 15 is dimensioned to receive the lengthening blade assembly. A cylindrical bar 22 extends immediately adjacent channel 15 and is generally perpendicular to the path traversed by stuffers 8 and lengthening blades 14.

Figure 3:
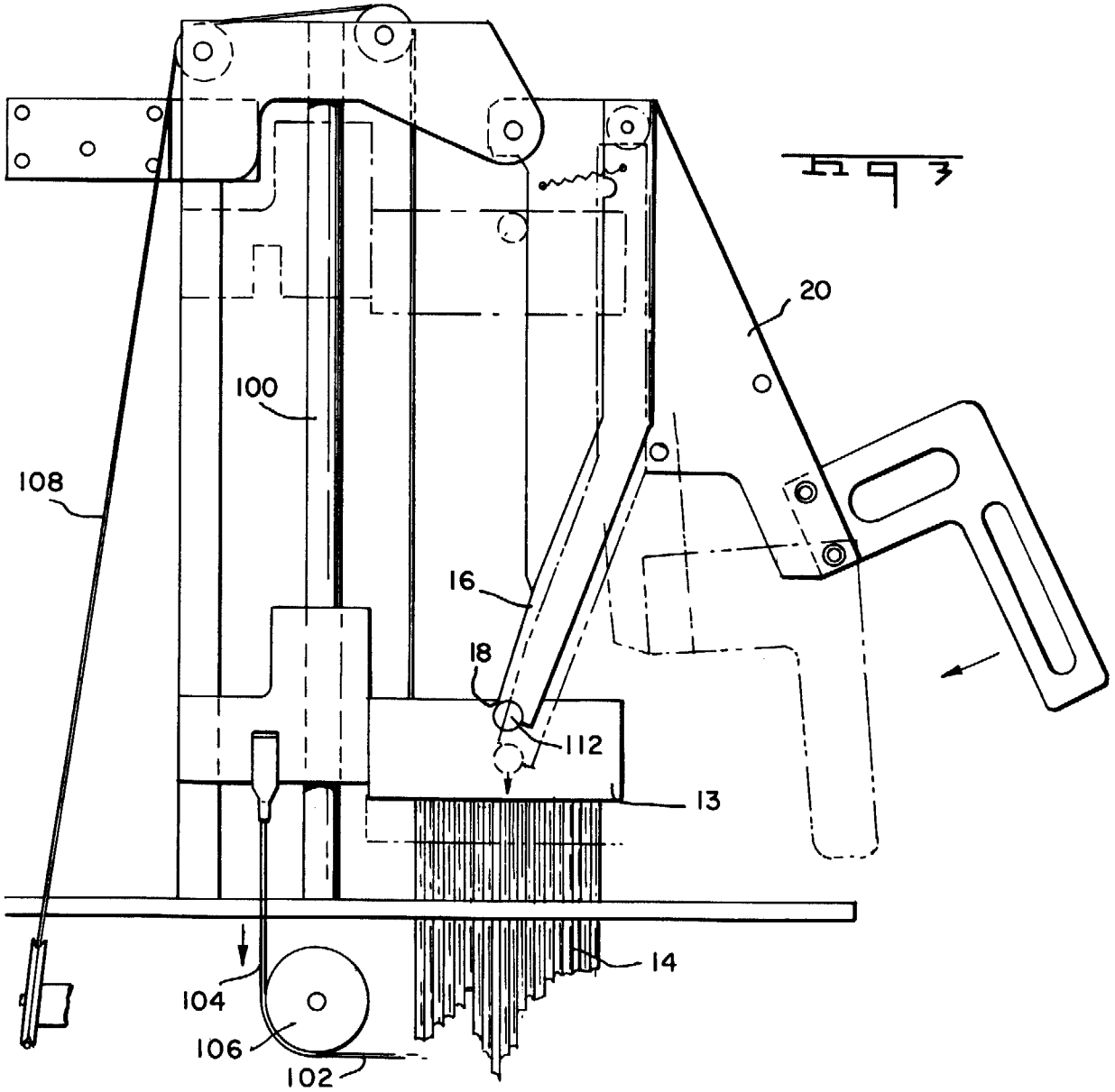
FIG. 3 shows the lengthening blade mechanism.

Lever 20, which is intended to be hand actuated, is connected to the lengthening blade assembly 13 as best shown in FIG. 3. This interconnection is established through arm 16. The lower end 18 of arm 16 is adapted to engage a pin 112 which is located on lengthening blade assembly 13. Lengthening blade assembly 13 is mounted on vertically extending support rod, again as shown in FIG. 3.

A plurality of lengthening blades 14 depend from assembly 13. Separate lengthening blades 14 generally differ in length.

Wire stripping means are located at station 6 which is laterally spaced from wire insertion station 4. Stripping station 6 comprises a vertically moving ram assembly 50, a prismatic stripping block assembly 40 and a plurality of stripping blades 42 as shown in FIGS. 6 and 7. Stripping block 40 comprises a plurality of prismatic spacer blocks 44. Spacer blocks 44 can be fastened together to form a common stripping block assembly. A plurality of parallel channels 46 extend inwardly from the top wire receiving surface of each block 44. These channels are formed between a plurality of ridges 45. Each channel 45 is greater than the diameter of the respective wire used at that position to fabricate a harness. The plurality of stripping blades 42 are plate-like members which can be positioned between adjacent spacer blocks 44 as shown in FIG. 6. Blades suitable for this purpose can consist of tempered carbon steel plates having a width of approximately 0.008 inches (0.02 cm.). Each plate 42 has one or more upstanding slotted members 48 extending from one longitudinal edge thereof. Each member 48 has inwardly extending slot 49. One plate 42 is illustrated in FIG. 6 with three upstanding slotted members designated as **48*a*, 48*b* and 48*c*. Each member 48*a*, *b* and *c* is intended for use in stripping the insulation from wires located in alignment with the respective slotted member. Fabrication of a stripping blade can be accomplished in one very advantageous manner shown with reference to FIG. 6A. Standard stampings can be provided with a plurality of slots extending inwardly from one edge thereof. A suitable tool can then be used to remove portions of the blade along this one edge leaving upstanding slotted members such as 48*a*, *b* and *c* as shown in FIG. 6. Removal of portions along this blade edge is facilitated by the relatively small thickness of the plate. When plates 42 are inserted between spacer blocks 44, ridges 45 therefore provide lateral support for the slotted members 48**. The use of this stripping assembly will be more specifically described in conjunction with the operation of the harness assembly apparatus.

A reciprocal shuttle 60 moves between wire insertion station 4 and wire stripping station 6. Shuttle 60 is shown in FIG. 1 in its retracted position at wire stripping station 6. Shuttle 60 is attached to linkage 64 which includes a handle 62. Movement of handle 62 to the right in FIG. 1 moves shuttle 60 from wire stripping station 6 to wire insertion station 4. Shuttle 60 moves along track 92.

Shuttle 60 comprises wire clamp 68, first wire guide member 70 and second wire guide member 74. Clamp 68 is fixed to support 82, which is in turn attached to shuttle linkage 64. Clamp 68 comprises a base portion 69 and a bar 88. Bar 88 is pivoted about one end 90 of base 69. A latching member 84 which engages the free end of bar 88 is located adjacent clamp support 82. As shown in FIG. 2 a plurality of wires extend through base 69 and are clamped between base 69 and clamping means 88. Rotation of latching member 84 releases clamping means 88 thus freeing the wires to move relative to wire clamp 68.

First wire guide 70 comprises an "L" shaped plate having a base 80 and a perpindicular flange 73. A plurality of individual holes are located in flange 73 and are adapted to receive wires adjacent their ends as shown in FIG. 2. Base 80 is attached to clamp 68. An elongated slot 71 located in base 80 permits first wire guide 70 to slide relative to clamp 68. Wire guide 70 is free to slide until flange 73 is immediately adjacent one side of wire clamp base 69.

A second wire guide 74 is attached to wire clamp 68 and first wire guide 72. Second wire guide 74 comprises a vertically extending plate member 75 attached at each end to guide track rod 78 and 78'. Rods 78 and 78' are in turn attached to first wire guide 72 and clamp 68. Second wire guide 74 is slidable relatively towards and away from first wire guide 72 and clamp 68. The entire wire guide and clamping assembly can be collapsed until plate 75 abuts flange 73, which in turn abuts one surface on clamp 68. A plurality of oval holes 76, with their major axis extending vertically, are located along plate 75. These oval holes are intended for precise aligning and the leading ends of wires 202. The function and operation of the shuttle assembly will be subsequently discussed with reference to FIGS. 8–15.

Figure 4:
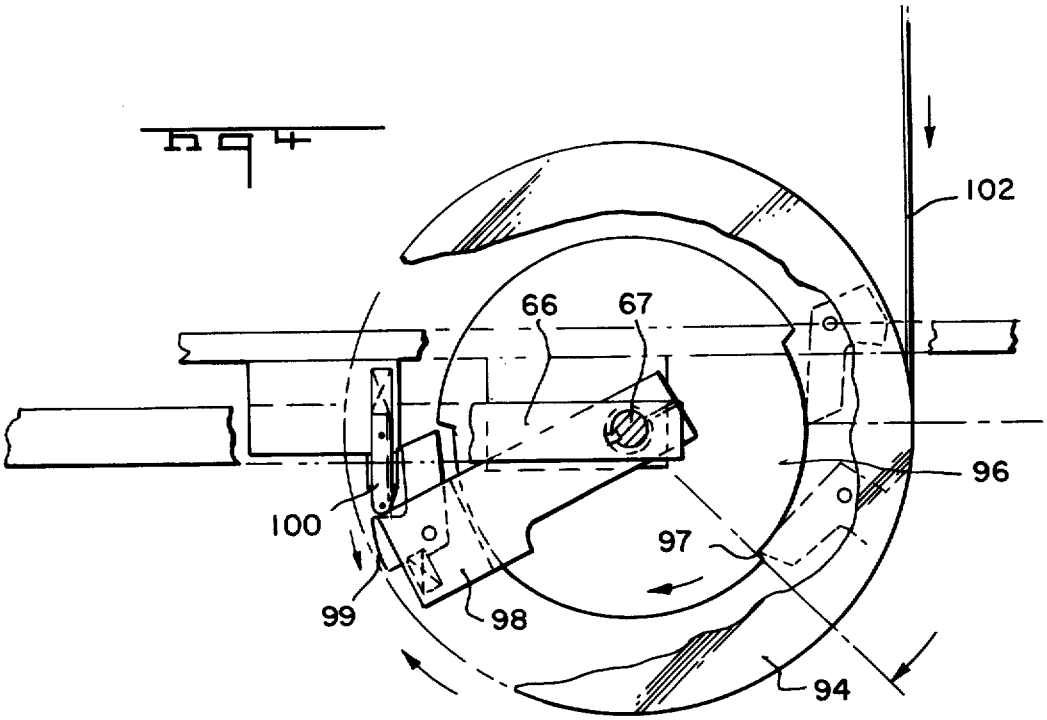
FIG. 4 is a plan view of the lengthening blade pulley mechanism.
Figure 5:
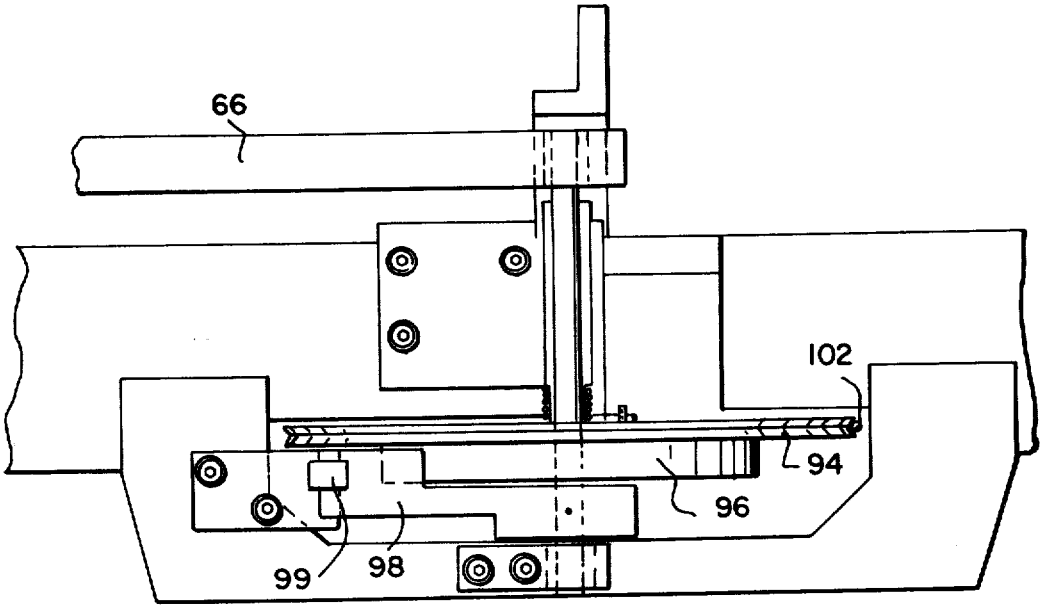
FIG. 5 is a side view of the pulley mechanism shown in FIG. 4.

Shuttle linkage 64 includes lever member 66. As handle 62 is moved to the right in FIG. 1, lever 66, as shown in FIG. 2, moves in a counter-clockwise direction about shaft 67. A first pulley 94 is free to rotate about shaft 67 but is not keyed to rotate with shaft 67. Lever 66 is keyed to shaft 67 so that counter-clockwise rotation of lever 66 causes concurrent counter-clockwise rotation of shaft 67. Member 98, extending radially outward below pulley 94, is also keyed to shaft 67 and lever 66. A rotary camming member 96 is fixed to the lower surface of pulley 94. Rotary camming member 96 has a step 97 along its circumferential edge. During counter-clockwise rotation of members 66 and 98 about the axis of shaft 67, the rotary cam 96 and first pulley 94 each remain stationary. An "L" shaped pawl 99 is attached to the outer end of member 98. The pawl is spring loaded in such a manner that it will engage step 97 after sufficient rotation of member 98. Engagement of step 97 by pawl 99 is shown in the phantom illustration in FIG. 4. Upon completion of the rightward movement of handle 62 and concurrently shuttle 60, in FIG. 1, pawl 99 engages step 97. As handle 62 is returned to the position shown by FIG. 1 pulley 94 rotates in a clockwise direction. Cable 102, which is attached to first pulley 94, is thus drawn in the direction of the arrow shown in FIG. 4 during retraction of the shuttle toward shuttle stripping station 6.

As shown in FIG. 3, cable 102 extends around the periphery of a second pulley 106 and is attached at 104 to lengthening blade assembly 13. Retraction of shuttle 60 and handle 62 toward stripping station 6 thus causes a downward extension of assembly 13 and lengthening blades 14.

OPERATION

The operation of the instant multi-wire harness applicator is shown in FIGS. 8–15, which represent a single cycle resulting in the fabrication of one harness.

Figure 8:
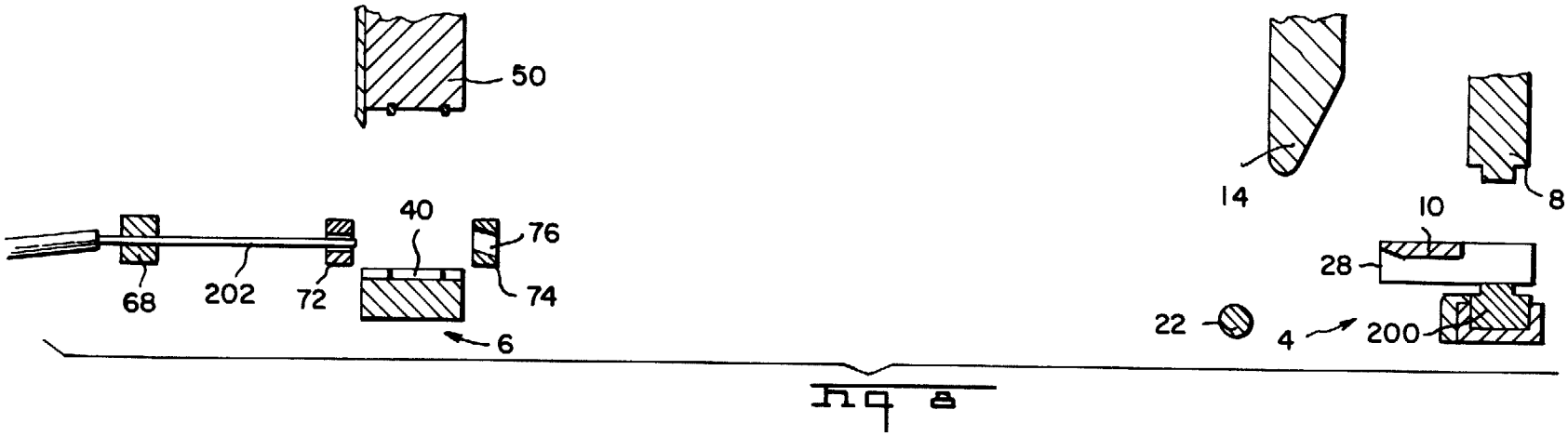

FIG. 8 represents the first step in the fabrication sequence. Insulated wires 202 are firmly gripped in clamping member 68 and extend through first wire guide 72. The wires are located generally at wire stripping station 6 with first and second wire guides 72 and 74 being on opposite sides of stripping block 40. Note that ram 50 is in the upright position. Lengthening blades 14 and wire stuffers 8 are both in the upright position at the wire insertion station 4.

Figure 9:
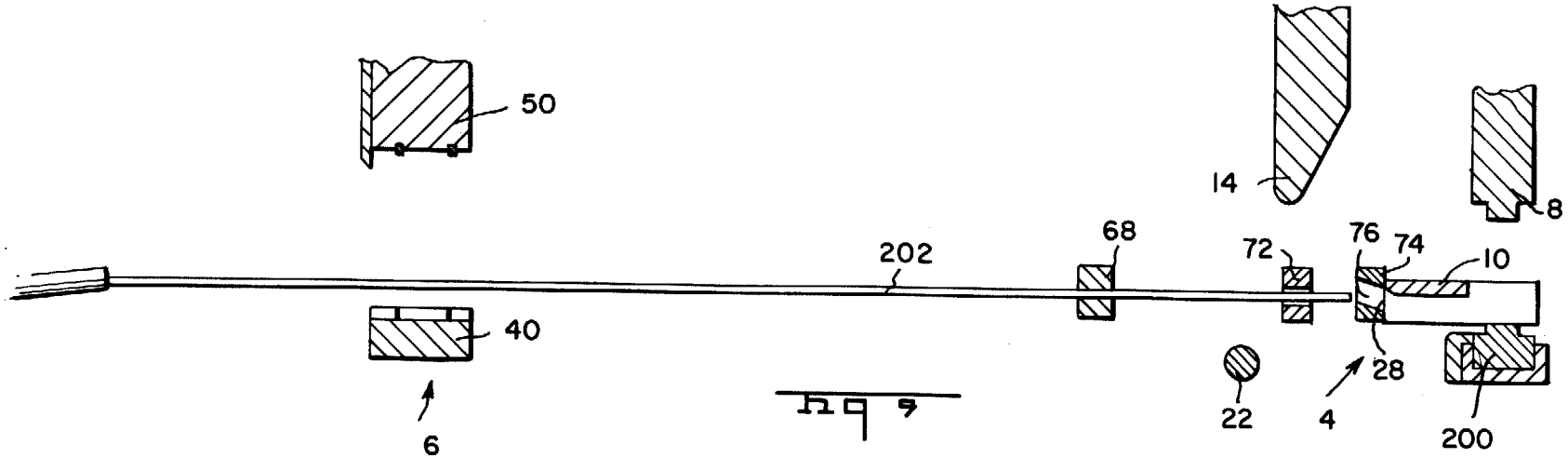

FIG. 9 illustrates the next step in this sequence. Clamp 68 has moved from wire stripping station 6 toward wire insertion station 4 drawing wires 202 with it. In FIG. 9 second wire guide member 74 abuts the left edge of template 10. Clamp 68 and first wire guide 72 continue to move after first wire guide 74 has been stopped by template 10. Note that the separation between first wire guide 72 and second wire guide 74 has decreased. It is also apparent that the oval holes 76 and second wire guide 74 are in precise alignment with wire slots 28 and template 10. The leading end of a wire 202 is shown just prior to entering oval holes 76. Note that the position of the lengthening blades 14 and the wire stuffer 8 has remained unchanged.

Figure 10:
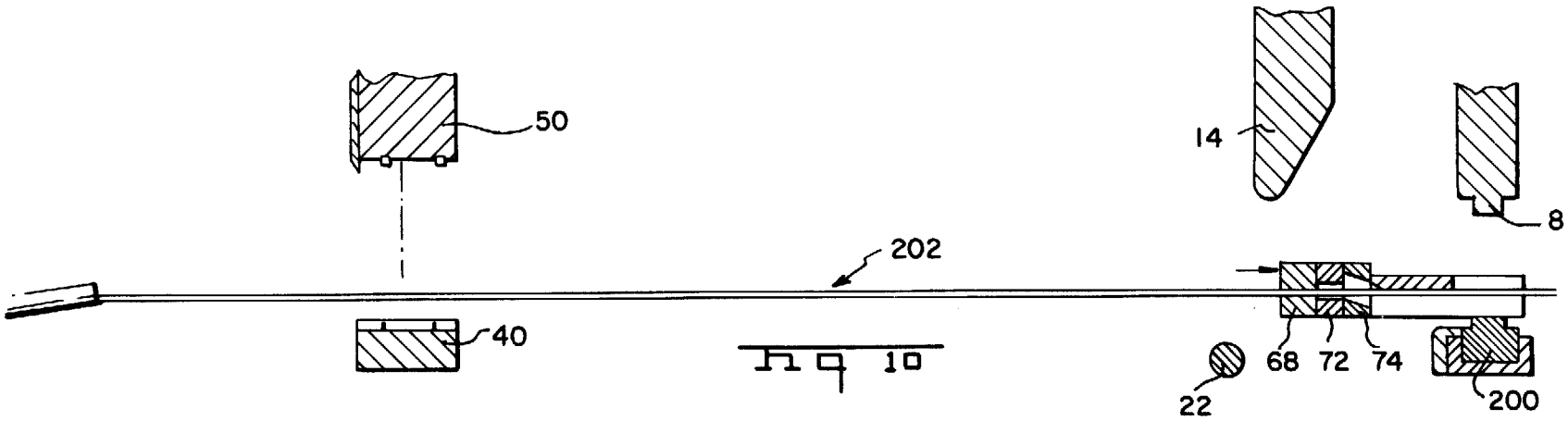

The advance of wire clamp 68 has continued in FIG. 10. Wire clamp 68 and first and second wire guides 72 and 74 are all in abutting relationship. As a result, a segment of wire 202 has been fed through the openings in template 10 and is now in alignment between wire stuffer 8 and connector 200. FIG. 10 represents the completion of the forward travel of shuttle 60, which comprises the clamp and first and second wire guide member.

Figure 11:
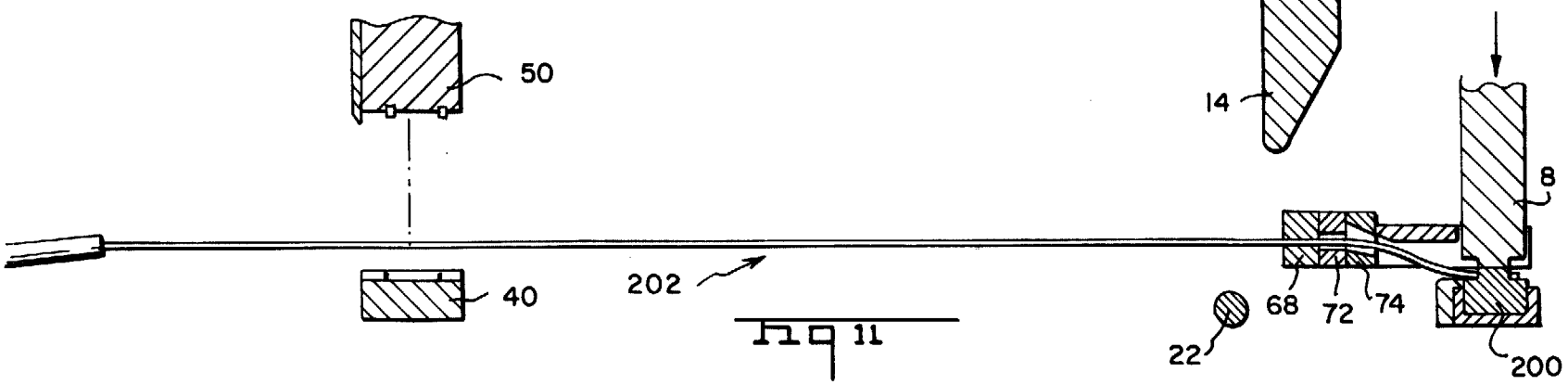

FIG. 11 illustrates the wire insertion step of this operation. Note that stuffer 8 has moved downward forcing wires 202 laterally of their axis and attaching each wire to an appropriate terminal in connector 200, thereby securing the wire ends at station 4. Referring to FIG. 1, this wire insertion operation is accomplished after the operator has moved handle 62 to the limit of its rightward travel. The operator then pushes switch 24 which activates stuffer 8.

Figure 12:
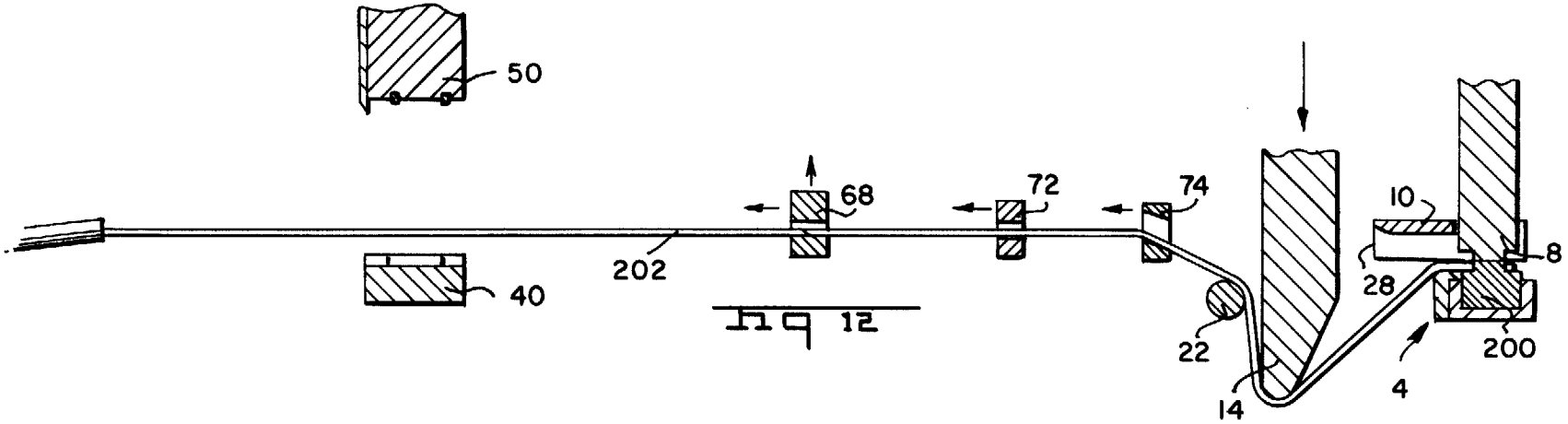
Figure 17:
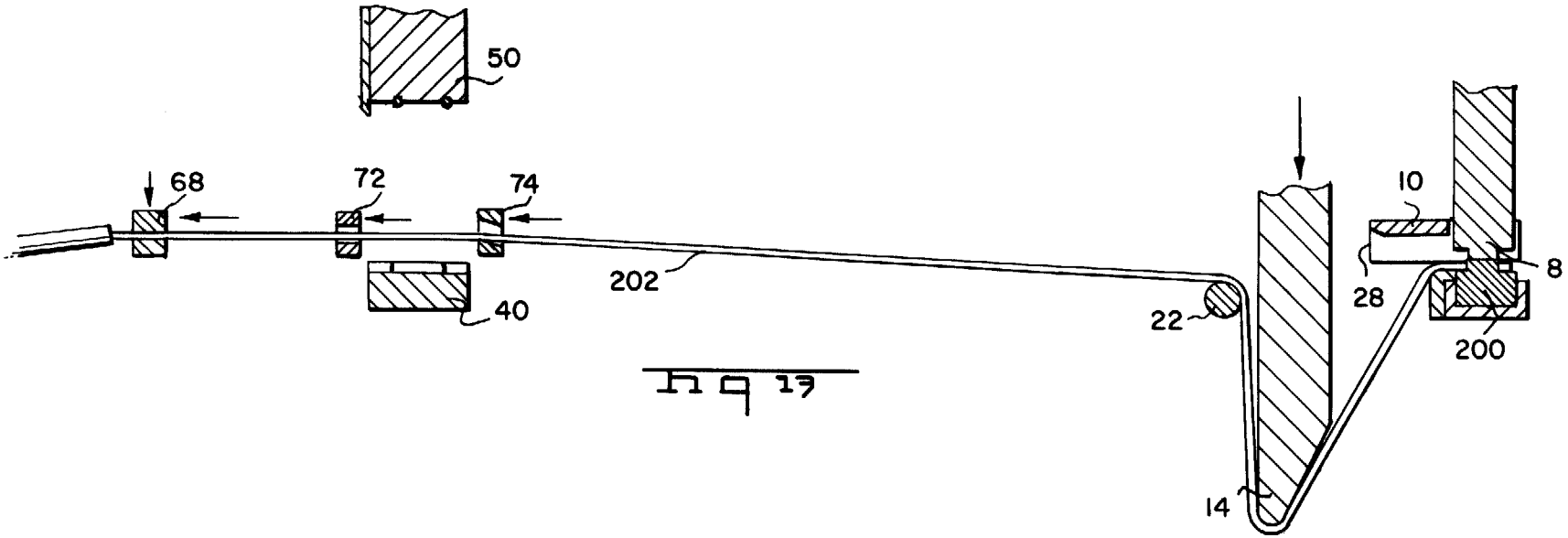

In FIG. 12 retraction of shuttle 60 has begun. Note that stuffer 8 remains in the extended position securing the ends of wires 202 in connector 200. The pressure exerted by clamp 68 on wires 202 has been released by rotation of latch 84 so that relative movement between the clamp and the wire is possible. During the step illustrated by FIG. 12, lengthening blades 14 move downward as shown. Lengthening blades 14 travel between bar 22 and the wire insertion assembly comprising, in part, wire stuffers 8. Clearly, additional wire is drawn from its supply reels by this movement of lengthening blades 14, to form loops between the first and second stations.

In FIG. 13 clamp 68 and first wire guide 72 have retracted past wire stripping block 40. Second wire guide 74 remains on the right side of stripping block 40. Note the member 68, 72, 74 have each returned to their respective beginning positions as shown in FIG. 8. FIG. 13 shows that lengthening blades 14 have continued their downward travel, relative to FIG. 12, drawing further lengths of wire 202. The travel of blades 14 is now complete, at least insofar as the differential wire lengthening is concerned. In FIG. 3 the differing lengths of separate lengthening blades 14 is illustrated. Upon reflection it is apparent that the longer blades draw a greater length of wire from the supply reels resulting in unequal wire segments extending between wire insertion station 4 and wire stripping station 6. The continued movement of lengthening blades 14, shown in FIG. 13, is generated by the leftward movement of handle 62. Leftward movement of handle 62 generates clockwise movement of pulley 94 as discussed with reference to FIG. 4. Cable 102 then pulls the lengthening blade assembly 13 as shown in FIG. 3.

Figure 14:
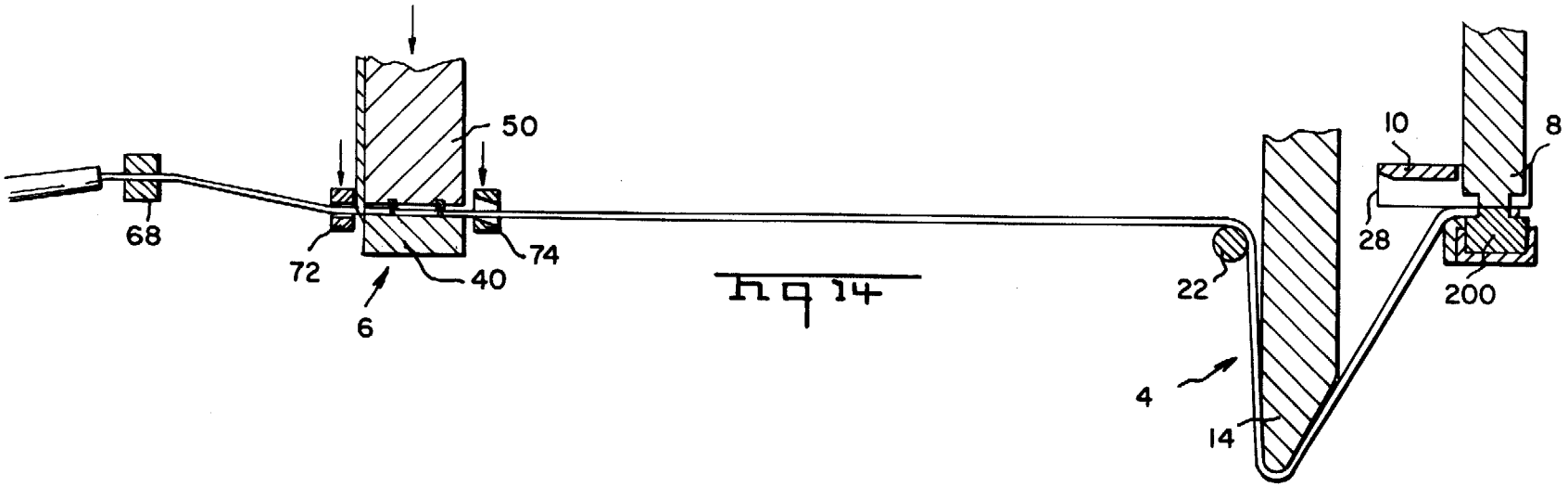

FIG. 14 illustrates the beginning of the wire shearing and stripping operation. Guides 72 and 74, on opposite sides of stripping block 40 serve as means to align the wires with respective channels. Stripping ram 50 moves toward stripping block 40 forcing movement of guides 72 and 74 through cam pins 52 and cam members 54, respectively. Each wire 52 now rests in a stripping channel 46 as shown in FIG. 7. A portion of the insulation has been severed by slots 49 and stripper member 48. A movable shearing blade 56 attached to ram 50 has moved past a fixed shearing edge 116 located on stripper block 40, thus severing each wire 202.

FIG. 7A illustrates the insertion of a wire 202 into a channel and the associated slotted member 48. Note that the bottom surface 50 abuts the top of wire 202 and the top of stripping block assembly 40. The depth of slot 49 is greater than the sum of the insulation thickness of wire 202 plus the core diameter 203. Therefore, the slotted member 48 effectively severs the insulation on three sides of core 203. FIG. 7 also shows the relative positions of first and second wire guide members 72 and 74. First wire guide member 72 is located on the left or rear of stripping block assembly 40 while second wire guide member 74 is shown on the right in FIG. 7. The wire guide members precisely align the wires with channels 46 prior to the insertion of each wire into the appropriate channel by movement of ram 50.

Figure 15:
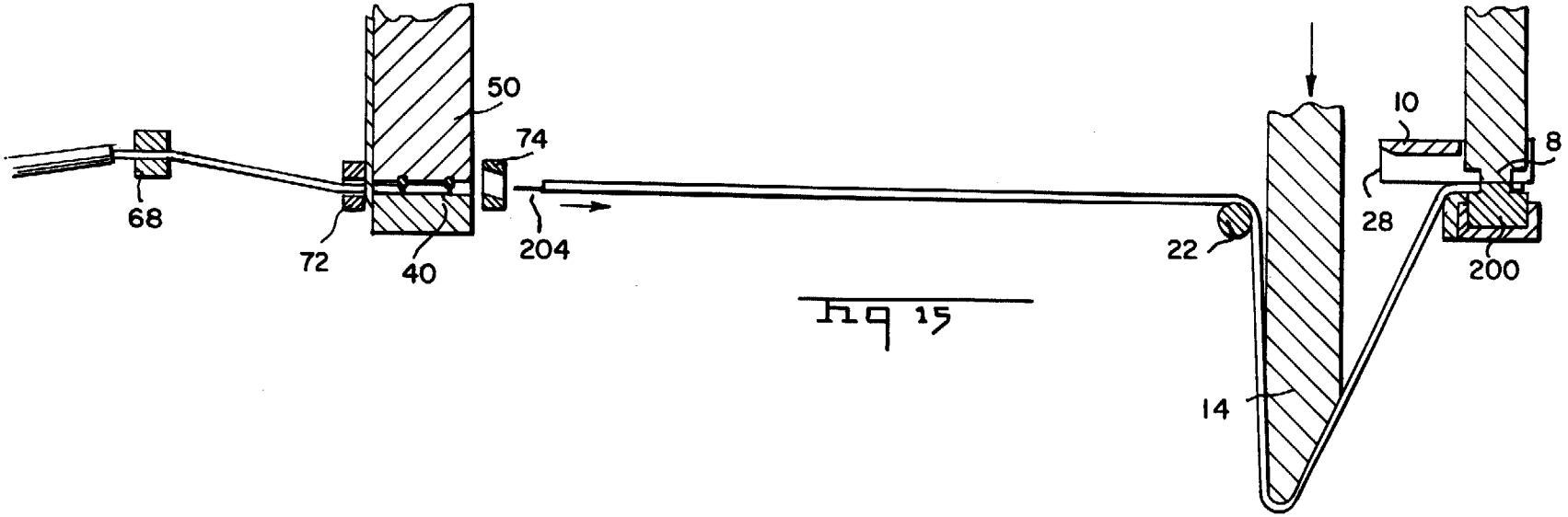

FIG. 15 illustrates the completion of the assembly of a single harness. Lengthening blades 14 are now driven through a further incremental travel. By pushing handle 20 the operator forces the lengthening blade assembly through this incremental travel as will be apparent in FIG. 3. This last incremental movement of lengthening blade 14 pulls the rear of wires 202 through channel 46 as shown, a phantom illustration, in FIG. 7. A portion of the insulation remains behind and stripped ends 204 are now free. Note that the length of each strip in 204 is dependent upon the spacing between slotted stripped member 48 and the end of the channel 46 where the wire is initially sheared. To change the pattern of variable stripping, new blades which can be fabricated from standard stock 42 can be inserted into the stripping block assembly as previously described. Wire stuffer 8, lengthening blade 14 and stripping ram 50 can now be returned to their retracted position and the assembly apparatus will be in the position represented by FIG. 8. A new cycle can now be initiated and another identical harness can be fabricated.

What is claimed is:

1. A method of fabricating an electrical harness, which comprises at least one multi-contact electrical connector and a plurality of insulated wires extending therefrom, said wires generally being of different lengths with diverse segments of insulation removed from the wire ends opposite said connector, said method comprising the steps of:

positioning said electrical connector at a first station, simultaneously feeding first ends of said plurality of wires uniformly past a second station to a first station, said second station being spaced from said first station by a distance no greater than the length of the shortest of said plurality of wires, inserting said first ends of said wires in said electrical connector at said first station, forming loops of differential lengths in said wires between said first and second stations, pressing said wires into axially extending channels adjacent to said second station, each of said channels having a cutting blade therein for partially severing the insulation on said wires, gripping said wires adjacent to said second station, shearing said wires at said second station between said cutting blades and the gripping of said wires, and imparting an axial force upon said wires between said cutting blades and said first station to draw said wires past said cutting blades and strip the wire insulation which previously had extended between said blades and said sheared end.

2. A method as set forth in claim 1 wherein said loop is formed by moving a ram laterally of the axis of each wire between said first and said second station.

3. A method as set forth in claim 2 wherein said axial force is imparted by moving said ram through an additional increment.

4. A method as set forth in claim 3 wherein said first ends are secured at said first station by moving each wire laterally of its axis into a terminal contained in said connector, said terminal forming a mechanical and electrical interconnection with said respective wire.

5. A method as set forth in claim 2 wherein said first ends are initially fed into a template at said first station, said template having passages aligned with terminals in said connector, said first ends being moved laterally into said terminals by stuffer members moving through said passages.

6. A method as set forth in claim 1 wherein said wires are fed from supply reels so that identical harnesses can be successively fabricated.

7. A method as set forth in claim 6 wherein said wires are pulled from said supply reels past said second station to said first station.

8. Apparatus for fabricating an electrical harness, said harness comprising at least one multi-contact electrical connector and a plurality of insulated wires extending therefrom, said wires generally being of differing lengths with unequal segments of insulation removed from the wire ends opposite said connector, said apparatus comprising:

a reciprocal shuttle movable through an extension phase from a first position to a second position, and movable through retraction phase from said second position to said first position, wire clamping means on said shuttle, said wire clamping means gripping said wires adjacent the free ends thereof during said extension phase, and releasing said wires during said retraction phase, securing means for securing said free ends of said wires during said retraction phase, lengthening means for forming a loop in each said wire between said shuttle and said second position during said retraction phase, loops in separate wires being generally unequal, and wire stripping means at said first position comprising:

channels generally aligned with said wires held in said shuttle, first means for pressing said wires into said channels, second means for at least partially severing the insulation on said wires as said wires are pressed into said channel means, third means for shearing said wires, and fourth means for pulling said wires through said channels to remove the insulation from the portion of said wires initially located between said second means and said third means.

9. Apparatus as set forth in claim 8 wherein said shuttle is movable along a linear path.

10. Apparatus as set forth in claim 9 wherein said fourth means comprises means for moving said lengthening means through an additional incremental distance.

11. Apparatus as set forth in claim 10 wherein said lengthening means comprises laterally moving means moving transversely of the path of said reciprocal shuttle.

12. Apparatus as set forth in claim 8 wherein said second means comprises blades located in said channels, each of said blades being unequally spaced from said third means so that said unequal segments of insulation can be removed from said wires.

13. Apparatus as set forth in claim 8 wherein said reciprocal shuttle further comprises wire guide means, said wire guide means being between said wire clamping means and said free ends of said wires, said wire guide means being spaced from said wire clamping means at said first position and abutting said wire clamping means at said second position to expose an additional length of wire beyond said wire guide means to said securing means for securing said free ends of said wires after said extension phase.

14. Apparatus as set forth in claim 13 wherein said wire guide means comprises first and second wire guide members, said first and second members being on opposite sides of said channels when said shuttle is at said first position to generally align each of said wires with a respective channel.

15. Apparatus for stripping the insulation from the free ends of insulated wires comprising:

stripping means having a wire receiving surface with a plurality of wire-receiving channels extending across said surface, one channel for each wire to be stripped, a stripping blade means in each channel, said stripping blade means extending transversely of said channel, a slot extending inwardly from the upper edge of each stripping blade means, each slot extending into the respective channel, means for positioning each wire to be stripped in general alignment with a channel, means for pressing each wire into the aligned channel, said wire being pressed into said slot so that said slot partially severs said insulation, and means for pulling said wires axially through said channels, whereby the insulation between said blade and the adjacent free end of said wire is stripped from said wire.

16. Apparatus as set forth in claim 15 wherein shear means cut said wires adjacent said stripping block means to define said free ends.

17. Apparatus as set forth in claim 15 wherein said stripping block means comprises a plurality of separate blocks having aligned channels, each of said stripping blades being positioned between adjacent blocks.

18. Apparatus as set forth in claim 17 wherein said blades in different channels are positioned at different axial locations so that different wires are stripped differentially when subject to the same force by said means for pulling said wires.

19. Apparatus as set forth in claim 15 wherein said means for pulling said wires axially through said channels comprises means moving transverse of the axis of said wires between said ends of said wires.

20. Apparatus for stripping the insulation from the free ends of insulated wires comprising:

a plurality of prismatic members each having a plurality of channels, extending across one surface thereof, defined by a plurality of parallel ridges extending from one side of each said prismatic member, said prismatic members being positioned in side-by-side configuration with said ridges and said channels in alignment, a relatively thin plate-like member extending between adjacent prismatic members, each plate-like member having an upstanding member extending from one side thereof, said upstanding member being aligned with one of said channels, said upstanding member having a slot extending inwardly from the free-end thereof, said slot being located within said one channel, first means for fastening said prismatic members and said plate-like members together, forming a prismatic assembly, second means for aligning at least one wire with each of said channels, third means for pressing one wire into one channel with said wire being forced into the slot in each said channel to partially sever the insulation on said wire, fourth means for shearing said wires adjacent one end of said prismatic assembly, fifth means for pulling said wires axially through said channels away from said fourth means to remove the insulation between each said upstanding member and the sheared end of wire in the same channel.

21. Apparatus as set forth in claim 20 wherein said third means comprises a movable ram member with said movable ram member containing said wires and preventing lateral movement of said wires as said wires are pulled from said channels.

22. Apparatus as set forth in claim 21 wherein said second means comprises a pair of guide means, one each located on opposite sides of said prismatic assembly, said guide means having apertures for receiving said wires therethrough, said apertures being in alignment with said channels.

* * * * *